US009050641B2

(12) United States Patent
Cho

(10) Patent No.: US 9,050,641 B2
(45) Date of Patent: Jun. 9, 2015

(54) DEVICE AND METHOD FOR HOT STAMPING

(71) Applicant: Hyundai Motor Company, Seoul (KR)

(72) Inventor: Jong Kun Cho, Ulsan (KR)

(73) Assignee: Hyundai Motor Company, Seoul (KR)

( * ) Notice: Subject to any disclaimer, the term of this patent is extended or adjusted under 35 U.S.C. 154(b) by 359 days.

(21) Appl. No.: 13/717,382

(22) Filed: Dec. 17, 2012

(65) Prior Publication Data

US 2014/0096583 A1 Apr. 10, 2014

(30) Foreign Application Priority Data

Oct. 5, 2012 (KR) ..... 10-2012-0110934

(51) Int. Cl.

| | |
|---|---|
| ***B21D 28/00*** | (2006.01) |
| ***B21D 22/02*** | (2006.01) |
| ***B21D 22/20*** | (2006.01) |
| ***B21D 24/08*** | (2006.01) |
| ***B21D 24/16*** | (2006.01) |
| ***B21D 37/16*** | (2006.01) |

(52) U.S. Cl.

CPC ..... *B21D 28/00* (2013.01); *B21D 22/022* (2013.01); *B21D 22/208* (2013.01); *B21D 24/08* (2013.01); *B21D 24/16* (2013.01); *B21D 37/16* (2013.01)

(58) Field of Classification Search

CPC ..... B21D 28/00; B21D 22/02; B21D 22/022; B21D 22/22; B21D 24/00; B21D 22/208; B21D 37/16; B21D 35/001; B21D 24/16; B21J 13/02; B21J 5/00

USPC ..... 72/1, 2, 3, 4, 5, 320, 342.4, 342.5, 347, 72/348, 334, 324, 332, 337, 338, 342.1, 72/342.2, 342.3, 362, 364, 377, 394, 401; 148/637, 644, 647, 654, 658, 660, 661, 148/664; 83/21, 169–171, 684, 698.91, 83/621, 613, 618, 694, 690, 688

See application file for complete search history.

(56) References Cited

U.S. PATENT DOCUMENTS

| | | | | |
|---|---|---|---|---|
| 6,367,304 | B1 * | 4/2002 | Fahrenbach | 72/342.3 |
| 2010/0126640 | A1 * | 5/2010 | Fang | 72/332 |

FOREIGN PATENT DOCUMENTS

| | | | |
|---|---|---|---|
| JP | 07-32930 | B2 | 4/1995 |
| KR | 10-2009-0108909 | A | 10/2009 |

* cited by examiner

*Primary Examiner* — Shelley Self
*Assistant Examiner* — Marc Payne
(74) *Attorney, Agent, or Firm* — Mintz Levin Cohn Ferris Glovsky and Popeo, P.C.; Peter F. Corless

(57) ABSTRACT

Disclosed herein is a hot stamping device for forming, cooling and trimming a material heated to a set temperature including a lower stanchion having a lower mold steel formed to a shape corresponding to a bottom surface of the material and a blank holder vertically movable on an exterior of the lower mold steel; a lower trimming steel mounted on the blank holder, configured to support the edges of the material; an upper stanchion having an upper mold steel formed to a shape corresponding to an upper surface of the material, and configured to move the upper mold steel up and down; an upper trimming steel disposed on an exterior of the upper mold steel move downwardly with the lower trimming steel to trim the edges of the material; and a cooling unit disposed on to the lower and the upper mold steels and the lower and the upper trimming steels, and configured to circulate coolant.

20 Claims, 9 Drawing Sheets

DEVICE AND METHOD FOR HOT STAMPING

CROSS-REFERENCE TO RELATED APPLICATION

This application claims priority to and the benefit of Korean Patent Application No. 10-2012-0110934 filed in the Korean Intellectual Property Office on Oct. 5, 2012, the entire contents of which are incorporated herein by reference.

BACKGROUND OF THE INVENTION (a) Field of the Invention

The present invention relates to a device for hot stamping. More particularly, the present invention relates to a device and a method for hot stamping in which forming and cooling of steel heated to a set temperature are simultaneously performed to form ultrahigh strength steel.

(b) Description of the Related Art

Recently, use of ultrahigh strength steel has increased in the vehicle industry to decrease weight of vehicle body and improve safety. Ultrahigh strength steel is steel having tensile strength of over 1300 MPa. Particularly, the forming method of the ultrahigh strength steel having tensile strength of over 1500 MPa includes hot stamping.

Hot stamping is a method for manufacturing ultrahigh strength steel components with boron steel having high heat treatability. The boron steel may be heated to a temperature at which austenite may be formed. The austenite formed by heating the boron steel may be cooled and simultaneously formed so a phase thereof is transformed to martensite.

The hot stamping method is applied to ensure strength of a center pillar, a roof rail, a bumper, and an impact beam. Thus, reinforcements may be removed, thereby decreasing the weight of the vehicle body.

However, the whole component formed by the hot stamping is formed of martensite and adapted to have ultrahigh strength. Therefore, it may be difficult to trim a metallic pattern to form the edge and flange of the components by shearing to form a contour. In particular, if trimming is performed on the metallic pattern, many burrs may be generated at a fracture of the component. Additionally, impact absorbing performance may be deteriorated when the fracture of the component is large, causing cracks at the fracture. Further, the trimmed metallic pattern may break and mass production of the component may be difficult.

Alternatively, laser trimming without using the metallic pattern can be applied. However, manufacturing cost and processing time may increase using laser trimming.

The above information is only for enhancement of understanding of the background of the invention and therefore it may contain information that does not form the prior art that is already known in this country to a person of ordinary skill in the art.

SUMMARY

The present invention provides a device for hot stamping wherein steel heated steel may be simultaneously formed and cooled in only one mold, and trimming of a metallic pattern of the steel may be performed at a high temperature. Additionally, the steel may be trimmed while the steel is simultaneously being cooled.

A device for hot stamping according to an exemplary embodiment of the present invention is configured to form, cool, and trim a material heated to a set temperature. The device may include: a lower stanchion having a lower mold steel formed to a shape corresponding to a bottom surface of the material and a blank holder disposed to move vertically along the exterior of the lower mold steel; a lower trimming steel mounted on the blank holder and configured to support edges of the material; an upper stanchion having an upper mold steel formed to a shape corresponding to an upper surface of the material, and configured to move the upper mold steel up and down; an upper trimming steel disposed outside of the upper mold steel corresponding to the lower trimming steel and moved downwardly with the lower trimming steel to trim the edges of the material; and a cooling unit respectively disposed to the lower and upper mold steels and the lower and upper trimming steels, and configured to circulate coolant.

In addition, the device may include a gap forming unit closely disposed near the upper trimming steel and the lower trimming steel to form a set gap between the lower and upper trimming steels. Further, the device may include a temperature sensor disposed at the lower trimming steel to detect a temperature of the material and output the detected temperature to a controller. The lower and upper trimming steels may move downwardly to trim the edges of the material when the temperature of the material detected by the temperature sensor is about 250° C. to 800° C.

The upper trimming steel may have a trimming blade trimming the edges of the material and at least one firming blade firming the trimmed portion. The firming blade may be a pair of firming blades disposed vertically apart from each other in an upper side of the trimming blade. The trimming blade may be include a tungsten carbide surfacing-welded to the upper trimming steel.

The trimming blade and the firming blades may be mounted on the upper trimming steel and be disposed at a distance corresponding to about 10% of a thickness of the material along the vertical direction.

The gap forming unit may include a plurality of housings closely mounted near the upper trimming steel; a gas spring mounted in the housing; a stroke block supported at a spring rod of the gas spring in the housing and protruded out of the housing; and a stopping block mounted toward the stroke block on the lower trimming steel. A stroke length of the stroke block may be 3 mm.

The cooling unit may be inserted into the lower and upper mold steels and the lower and upper trimming steels, and may include a bush member adapted to circulate the coolant. The cooling unit may further include a tank portion formed in the lower and upper mold steels and the lower and upper trimming steels, and a plurality of baffle plates disposed at the tank portion and configured to circulate the coolant. Furthermore, the cooling unit may be formed in the lower and upper mold steels and the lower and upper trimming steels, and may include a cooling channel configured to circulate the coolant.

A method for hot stamping according to an exemplary embodiment of the present invention may include circulating coolant into lower and upper mold steels and lower and upper trimming steels of lower and upper stanchions; loading a material at a set temperature to the lower mold steels and the lower trimming steels of the lower stanchions; forming the material by the lower and upper mold steels and the lower and upper trimming steels according to a downward movement of the upper stanchion; cooling the material with a coolant; detecting a temperature of the material by a temperature sensor; outputting the detected signal to a controller, trimming the edges of the material according to the downward movement of the upper stanchion, wherein the lower and upper trimming steels move downwardly with a blank holder when determined, by the controller, that the temperature of the material is within a first set temperature range; and completing the trimming according to an upward movement of the upper stanchion, wherein the lower and upper trimming steels move upwardly with the blank holder when determined, by the controller, that the temperature of the material is within a second set temperature range that is lower than the first set temperature range. Forming the material may further includes forming a set gap formed between the lower and upper trimming steels corresponding to the edges of the material.

The gap between the upper and upper trimming steels may be maintained at about 3 mm. The first set temperature range may be about 250° C. to 800° C. and the second set temperature range may be about 200° C. to 250° C.

The edges of the material may be trimmed by a trimming blade disposed on the upper trimming steel, and the trimmed portion of the material may be firmed by a firming blade disposed on the upper trimming steel when the lower and upper trimming steels move downwardly. Additionally, the trimmed portion of the material may be firmed by the firming blade when the lower and upper trimming steels move upwardly.

DESCRIPTION OF PREFERRED EMBODIMENTS

The present invention will be described more fully hereinafter with reference to the accompanying drawings, in which exemplary embodiments of the invention are shown. As those skilled in the art would understand, the described embodiments may be modified in various different ways, all without departing from the spirit or scope of the present invention.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller refers to a hardware device that includes a memory and a processor. The memory is configured to store the modules/units and the processor is specifically configured to execute said modules to perform one or more processes which are described further below.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Figure 1:
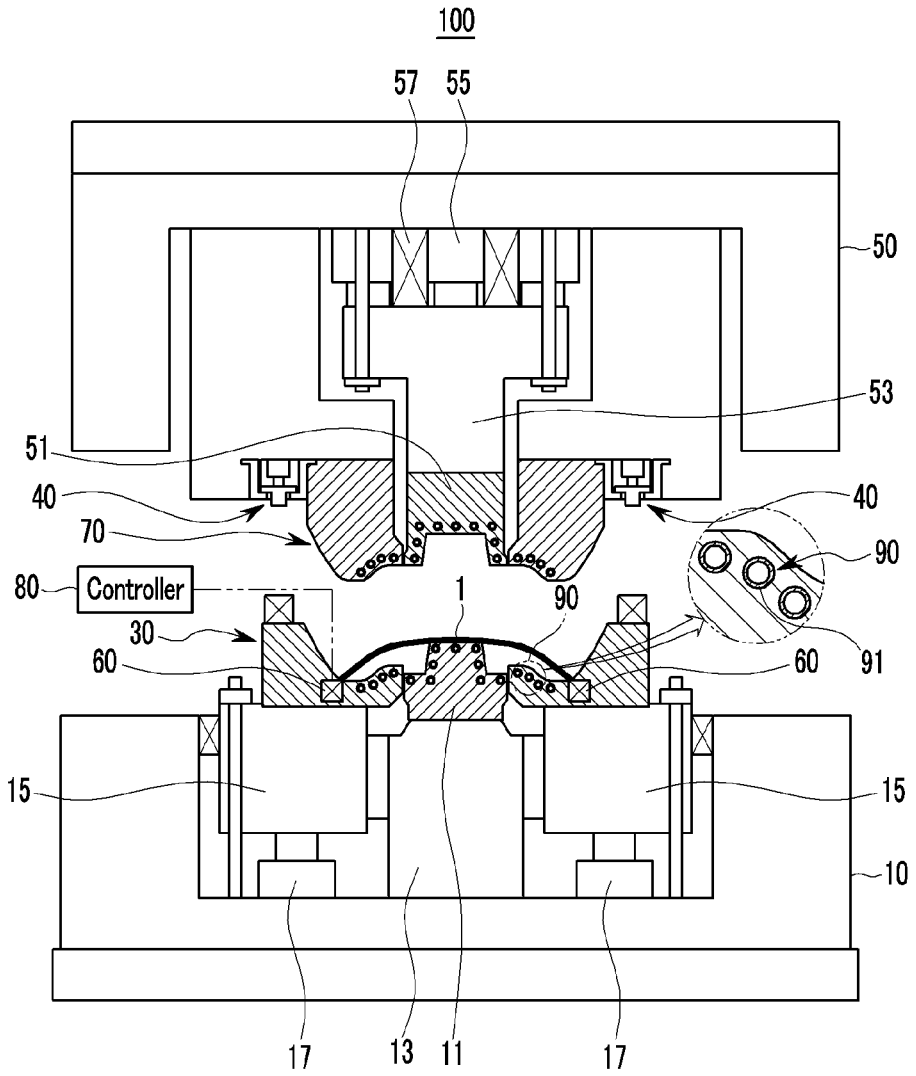
FIG. 1 is an exemplary schematic of a device for hot stamping according to an exemplary embodiment of the present invention.

FIG. 1 is an exemplary schematic diagram of a device for hot stamping according to an exemplary embodiment of the present invention.

Referring to FIG. 1, when using a hot stamping device 100 according to an exemplary embodiment of the present invention, a material 1 (conventionally referred to as a "blank") heated to a high temperature may be formed while simultaneously being cooled for manufacturing a formed object having ultrahigh strength.

For example, the hot stamping device 100 may heat a material 1, such as boron steel, having high heat treatability to a temperature at which austenite may be formed (e.g., about 900° C. to 950° C.). The hot stamping device may form the material 1 by using a mold while simultaneously cooling the material 1 to transform the phase of the material 1 to martensite to manufacture ultrahigh strength steel components. Herein, the vehicle body components may be members such as a center pillar, a roof rail, a bumper, and an impact beam.

The hot stamping device 100 according to an exemplary embodiment of the present invention may enable the heated material 1 to be formed while simultaneously being cooled in only one mold and may be trimmed at a high temperature.

According to exemplary embodiment of the present invention, the hot stamping device 100 may perform high temperature trimming while simultaneously forming and cooling the material 1.

The hot stamping device 100 may include a lower stanchion 10, a lower trimming steel 30, an upper stanchion 50, an upper trimming steel 70, and a cooling unit 90. The lower stanchion 10 may include a lower mold steel 11 and a blank holder 15 disposed on the exterior of the lower mold steel 11.

The lower mold steel 11 may have a shape corresponding to a bottom surface of the material 1 (conventionally referred to as a "blank") and may be fixed to a lower mold base 13 to support the inside edges of the material 1.

The blank holder 15 may be disposed on the exterior of the lower mold base 13 to be vertically movable by a lower gas spring 17 to apply blank holding force to the edges of the material 1. In other words, the blank holder 15 may compress the lower gas spring 17 by a compression force of the upper stanchion 50, and return to an original position by a restoring force of the lower gas spring 17 when the compression force is removed.

The lower trimming steel 30 may be mounted on the blank holder 15 to support the edges of the material 1 for trimming of the edges and firming of the trimmed portion. Furthermore, the lower trimming steel 30 may move downwardly with the blank holder 15 when the compression force of the upper stanchion 50 is applied to the blank holder 15, and may move upwardly with the blank holder 15 by force of the lower gas spring 17 when the compression force is removed.

The upper stanchion 50 may be disposed toward the lower stanchion 10 and may be vertically movable. Additionally, the upper stanchion may have a shape corresponding to an upper surface of the material 1, and may include an upper mold steel 51 compressing the material 1 with the lower mold steel 11.

The upper mold steel 51 may be mounted on an upper pad 53 corresponding to the lower mold steel 11. When the upper mold steel 51 contacts the lower mold steel 11 by the compression force of the upper stanchion 50, the upper pad 53 supports the compression force by an upper gas spring 55. In FIG. 1, reference numeral 57 indicates a strut block which may control a repulsive force of the material 1.

The construction and operation of the upper stanchion 50 are known to a person skilled in the art, so a detailed description thereof will be omitted.

The upper trimming steel 70 may support and trim the edges of the material 1 and firm the trimmed portion with the lower trimming steel 30. The upper trimming steel 70 may be disposed on the exterior of the upper mold steel 51 corresponding to the lower trimming steel 30.

Furthermore, the upper trimming steel 70 may support the edges of the material 1 using the lower trimming steel 30 when the upper stanchion 50 moves downwardly with the lower trimming steel 30 by the blank holder 15 to trim the edges of the material 1 and firm the trimmed portion.

The upper trimming steel 70 may move upwardly with the lower trimming steel 30 by the blank holder 15 to inversely firm the edges of the material 1 when the upper stanchion 50 moves upwardly. Herein, the firming (or crushing) may mean to crush burrs generated on the trimmed portion of the material 1.

The lower trimming steel 30 and the upper trimming steel 70 may perform trimming of the edges of the material 1 at a high temperature. In the high temperature trimming, the edges of the material 1 may be sheared wherein elongation of the steel is high and shearing stress of the steel is low.

Figure 2:
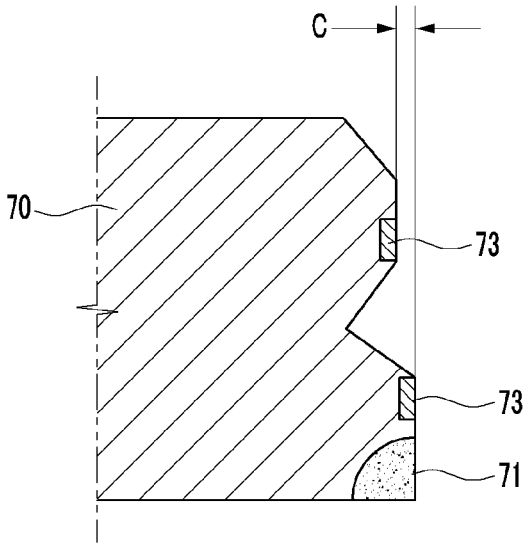
FIG. 2 illustrates an exemplary portion of trimming steel for applying a device for hot stamping according to an exemplary embodiment of the present invention.

According to an exemplary embodiment of the present invention, the upper trimming steel 70 for performing the high temperature trimming to the edges of the material 1 may include a trimming blade 71 configured to cut the edges of the material 1 and at least one firming blade 73 configured to firm the trimmed portion of the material 1, as shown in FIG. 2.

The trimming blade 71 may be formed of tungsten carbide surface-welded on a lower end of the upper trimming steel 70. The tungsten carbide exhibits wear resistance, satisfactory hardness at a high temperature, a lowest thermal expansion coefficient among metals, high density, high tensile strength, a high elastic modulus, and high high-temperature strength. In other words, the trimming blade 71 may be formed by surface-welding the tungsten carbide to prevent pressure, slip, or abrasion of the upper trimming steel 70 according to softening a portion of the upper trimming steel 70 by the high temperature trimming.

Alternatively, the firming blade 73 may be a pair disposed apart from each other in vertical directions at an upper side of the trimming blade 71.

The firming blade 73 may firm the burrs of the trimmed portion of the material 1 when the upper trimming steel 70 moves downwardly, and inversely may firm the burrs when the upper trimming steel 70 moves upwardly. Furthermore, the trimming blade 71 and the firming blades 73 may be mounted on the upper trimming steel 70 and may be disposed with a clearance C corresponding to about 10% of a thickness of the material along the vertical direction.

Specifically, the upper trimming steel 70 may have a set clearance between the trimming blade 71 mounted surface and the upper firming blade 73 mounted surface. The set clearance may allow compensation of thermal expansion of the upper trimming steel 70 generated by the high temperature trimming. Furthermore, the lower firming blade 73 may be mounted at an upper side of the trimming blade 71 on the trimming blade 71 mounted surface.

Referring to FIG. 1, the cooling unit 90 may cool the material 1 to a set temperature when the material 1 is supported by the lower and upper mold steels 11, 51 and the lower and upper trimming steels 30, 70 moving downwardly according to the upper stanchion 50.

The cooling unit 90 may be disposed at the lower and upper mold steels 11, 51 of the lower and upper stanchions 10, 50 and the lower and upper trimming steels 30, 70, and may be configured to circulate a coolant such as cooling water or a dry ice coolant.

For example, the cooling unit 90 may be inserted into the lower and upper mold steels 11, 51 and the lower and upper trimming steels 30, 70, and the cooling unit 90 may include a bush member 91 circulating the coolant.

The bush member 91 may be disposed on the interior of the steel lines of the lower and upper mold steels 11, 51 and the lower and upper trimming steels 30, 70 when the lower and upper mold steels 11, 51 and the lower and upper trimming steels 30, 70 are manufactured by die casting.

Figure 3:
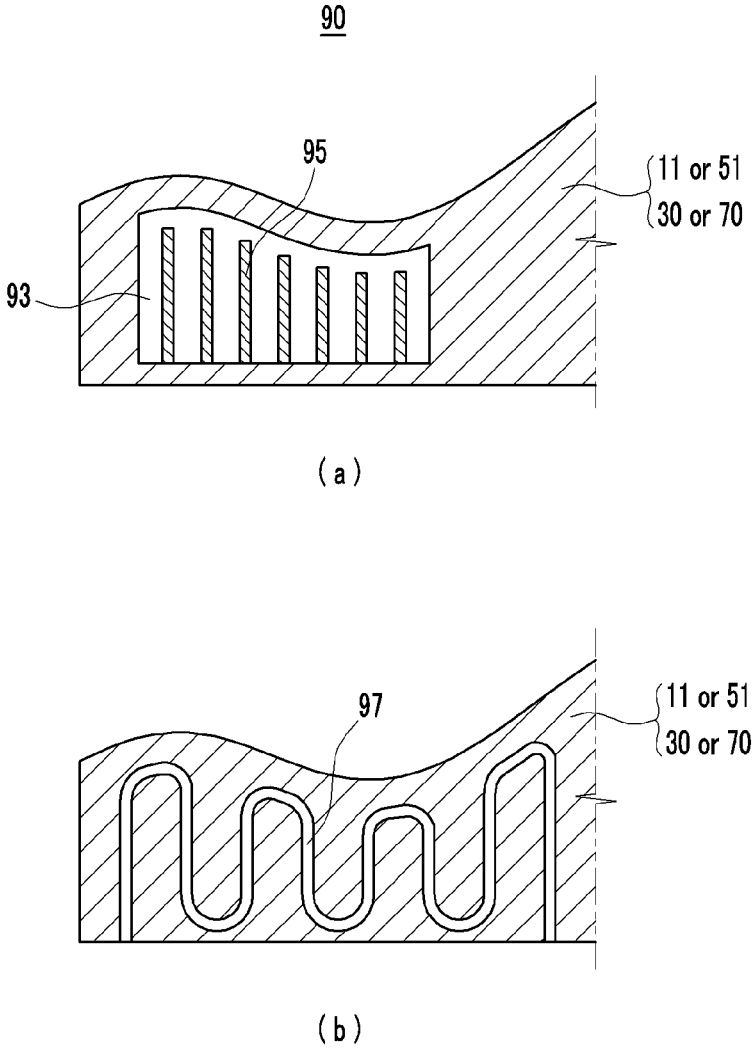
FIG. 3 is an exemplary schematic diagram of a cooling unit for applying to a device for hot stamping according to an exemplary embodiment of the present invention.

FIG. 3 is an exemplary schematic diagram of a cooling unit applied to a hot stamping device according to an exemplary embodiment of the present invention.

Referring to (a) of FIG. 3, the cooling unit 90 according to the first exemplary variation may include a tank portion 93 formed on the interior of the lower and upper mold steels 11, 51 and the lower and upper trimming steels 30, 70, and a plurality of baffle plates 95 mounted at the tank portion 93.

Furthermore, when strength of the lower and upper mold steels 11, 51 and the lower and upper trimming steels 30, 70 is maintained, the tank portions 93 may be formed on interiors thereof, and the baffle plates 95 may circulate the coolant through passageways between the baffle plates 95 in the tank portion 93.

Referring to (b) of FIG. 3, the cooling unit 90 according to the second exemplary variation may include a cooling channel 97 formed in the lower and upper mold steels 11, 51 and the lower and upper trimming steels 30, 70 along the steel lines thereof to circulate the coolant.

Moreover, the hot stamping device 100 according to an exemplary embodiment of the present invention may further include a temperature sensor 60 configured to detect a temperature of the material 1 and output the detected signal to a controller 80 during the material 1 forming as shown in FIG. 1.

According to an exemplary embodiment of the present invention, the temperature sensor 60 may be mounted at the lower trimming steel 30 and may be a conventional temperature sensor for measuring the temperature of the material 1 in real time. In other words, the lower and upper trimming steels 30, 70 may move downwardly and the high temperature trimming of the edges of the material 1 may be performed when the temperature of the material 1 detected by the temperature sensor 60 is about 250° C. to 800° C.

Furthermore, the temperature condition (e.g., about 250° C. to 800° C.) of the material 1 may be an optimum temperature condition to trim the edges of the material 1 by the lower and upper trimming steel 30, 70 at a high temperature. In addition, the temperature condition (e.g., about 250° C. to 800° C.) may be predetermined by various experiments.

Moreover, the hot stamping device 100 according to an exemplary embodiment of the present invention may further include a gap forming unit 40 for preventing expansion of the edges of the material 1 by a high temperature when the material 1 is supported by the lower and upper trimming steels 30, 70 as shown in FIG. 1. The gap forming unit 40 may be mounted on the lower and upper trimming steels 30 and 70 so as to form set gap G between the lower and upper trimming steels 30 and 70 corresponding to the edges of the material 1.

Figure 4:
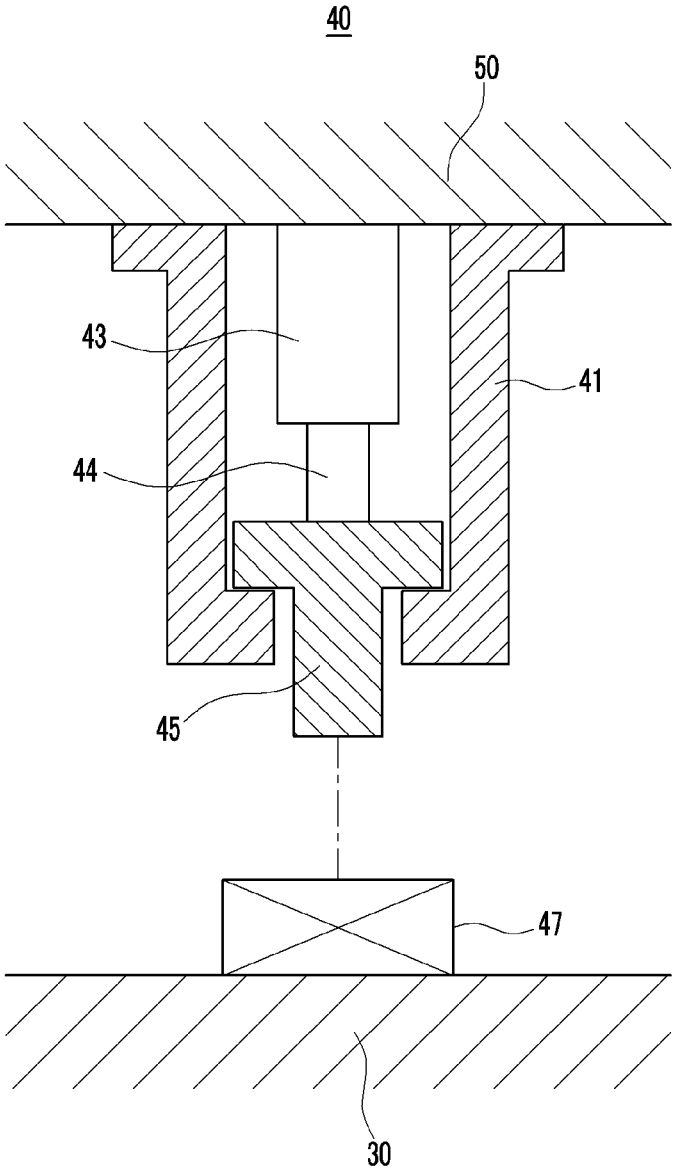
FIG. 4 is an exemplary cross-sectional view showing a gap forming unit for applying to a device for hot stamping according to an exemplary embodiment of the present invention.

FIG. 4 is an exemplary cross-sectional view showing a gap forming unit applied to a hot stamping device according to an exemplary embodiment of the present invention.

Referring to FIG. 1 and FIG. 4, the gap forming unit 40 according to an exemplary embodiment of the present invention may include a plurality of housings 41 mounted on the upper stanchion 50, a gas spring 43 disposed in the housing 41, a stroke block 45 supported at the gas spring 43 and protruded out of the housing 41, and a stopping block 47 mounted on the lower trimming steel 30.

The housing 41 may be closely disposed near the upper trimming steel 70, and the gas spring 43 may be fixed to the upper stanchion 50 in the housing 41. A spring rod 44 may be disposed to be vertically movable at the gas spring 43. The stroke block 45 may be supported at the spring rod 44 of the gas spring 43 in the housing 41 and may be movably disposed in interior and exterior directions of the housing 41. The stopping block 47 may mounted to correspond to the stroke block 45 and may be fixed to the lower trimming steel 30. The stopping block 47 may supply a repulsive force of the lower gas spring 17 to the stroke block 45 when the upper stanchion 50 moves downwardly.

For example, a stroke length of the stroke block 45 by the repulsive force of the lower gas spring 17 may be about 3 mm. In other words, the gap G having about a 3 mm thickness may be formed between the lower and upper trimming steels 30, 70 by the gap forming unit 40 when the material 1 is supported by the lower and upper trimming steels 30, 70.

Hereinafter, the operation of the hot stamping device 100 and the method for hot stamping by using the device 100 will be described in detail referring to the above-presented drawings and the following drawings.

Figure 7:
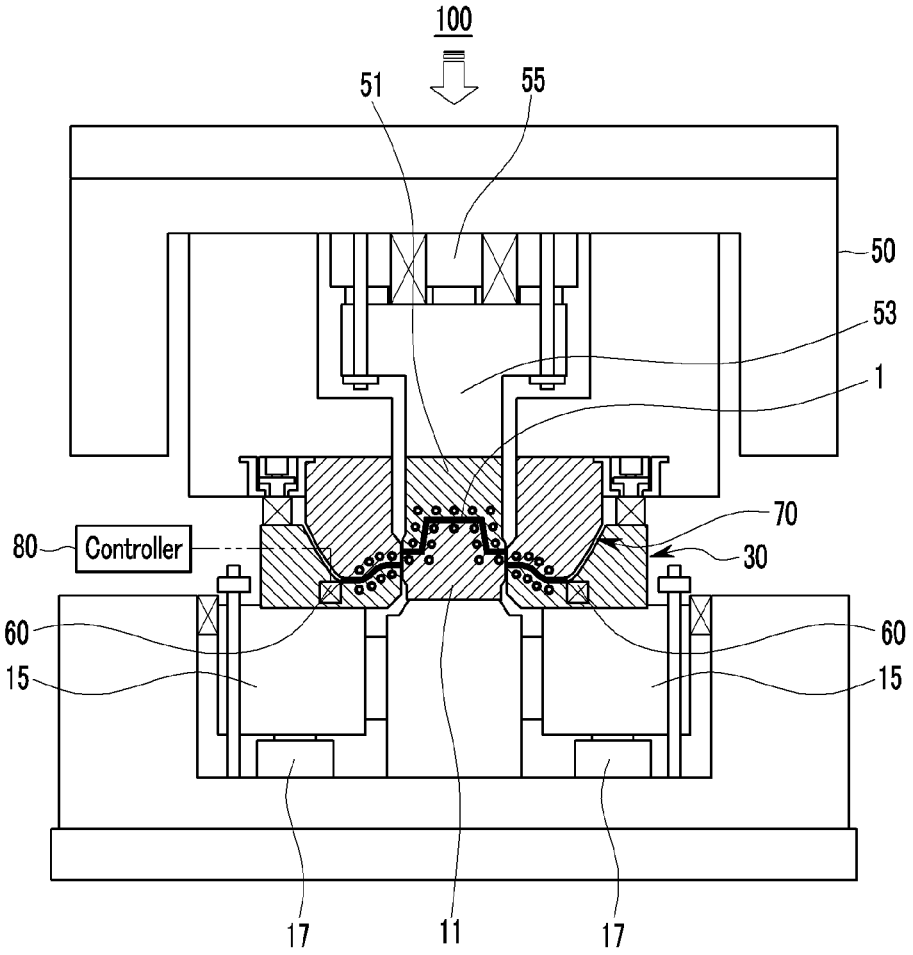
Figure 8:
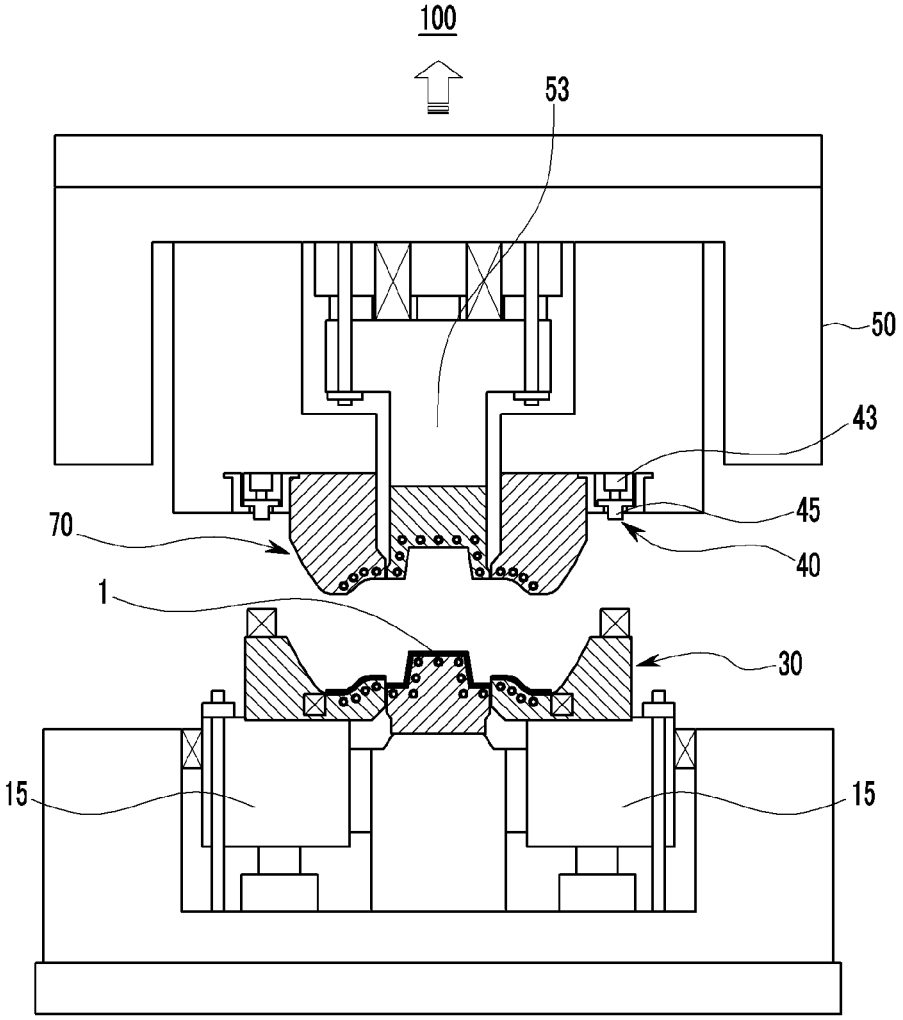
Figure 9:
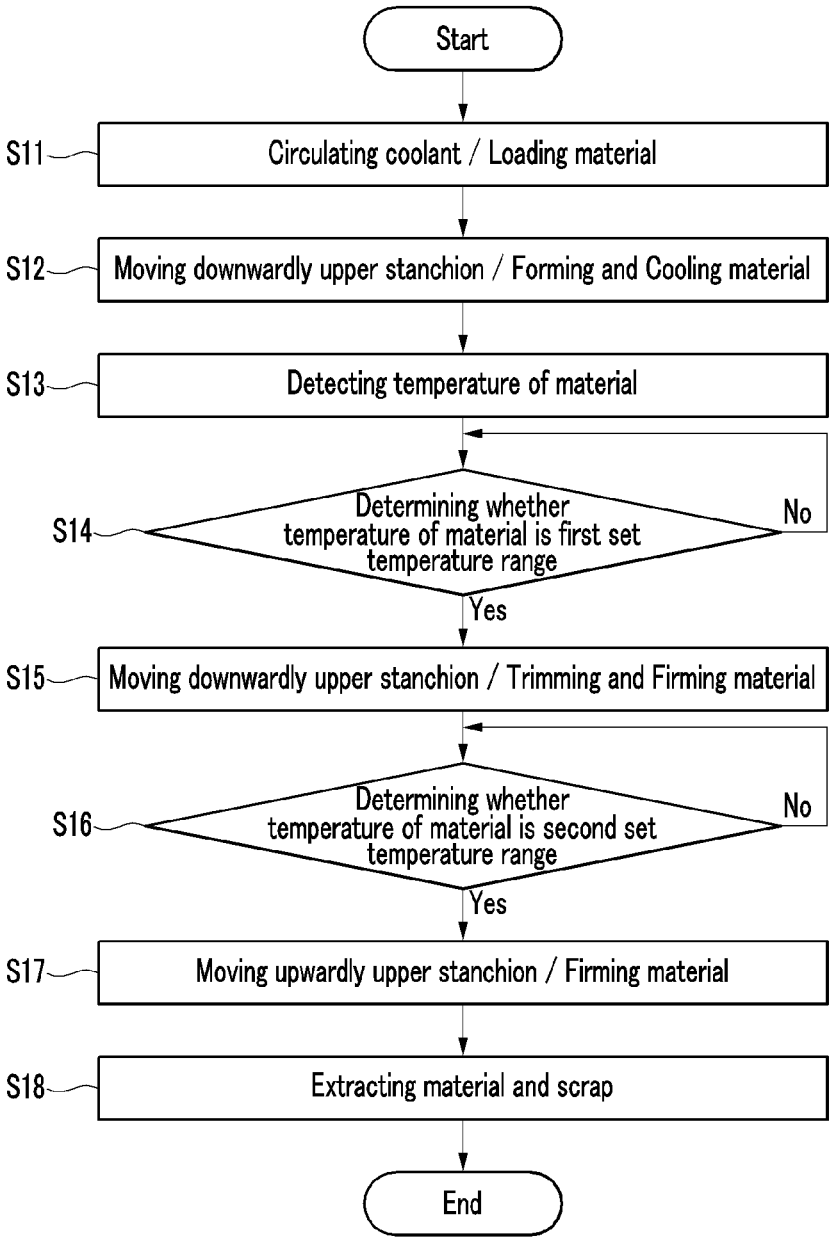
FIG. 9 is an exemplary flowchart of a method for hot stamping according to an exemplary embodiment of the present invention.

FIG. 5 to FIG. 8 illustrate an operational state of a hot stamping device according to an exemplary embodiment of the present invention, and FIG. 9 is an exemplary flowchart of a method for hot stamping according to an exemplary embodiment of the present invention.

Figure 5:
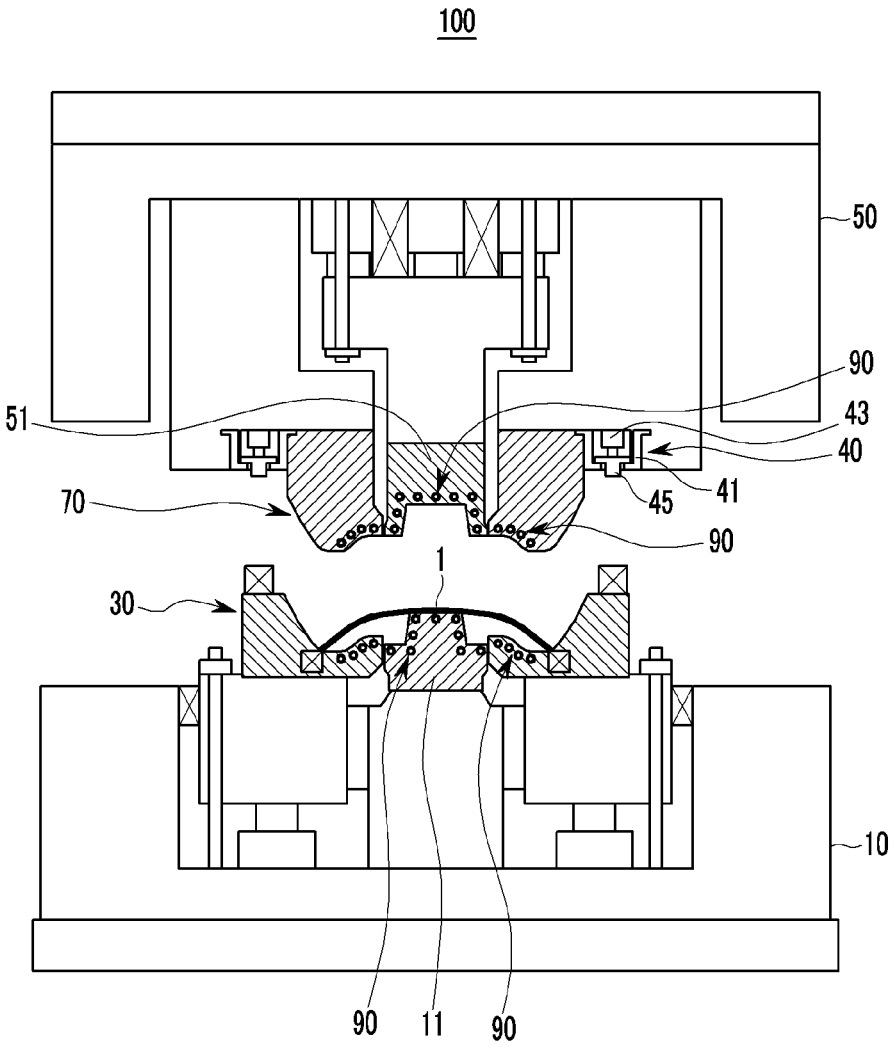
FIG. 5 to FIG. 8 illustrate a method for hot stamping according to an exemplary embodiment of the present invention.

As shown in FIG. 5 and FIG. 9, when the upper stanchion 50 is moved upward with reference to the lower stanchion 10, the material 1 heated to a temperature range of austenite formation (e.g., about 900° C. to 950° C.) may be loaded on the lower mold steel 11 and the lower trimming steel 30 of the lower stanchion 10 (S11).

Herein, the material 1 may be a boron steel applied to members such as a center pillar, a roof rail, a bumper, and an impact beam. Furthermore, the material 1 may be heated for about 6 minutes in a heating furnace (not shown).

At the step S11, the coolant such as cooling water or dry ice may be circulated by the cooling unit 90 of the lower and upper mold steels 11, 51 and the lower and upper trimming steels 30, 70 of the lower and upper stanchions 10, 50, and temperatures of the lower and upper mold steels 11, 51 and the lower and upper trimming steels 30, 70 may be set to a cooling temperature.

Figure 6:
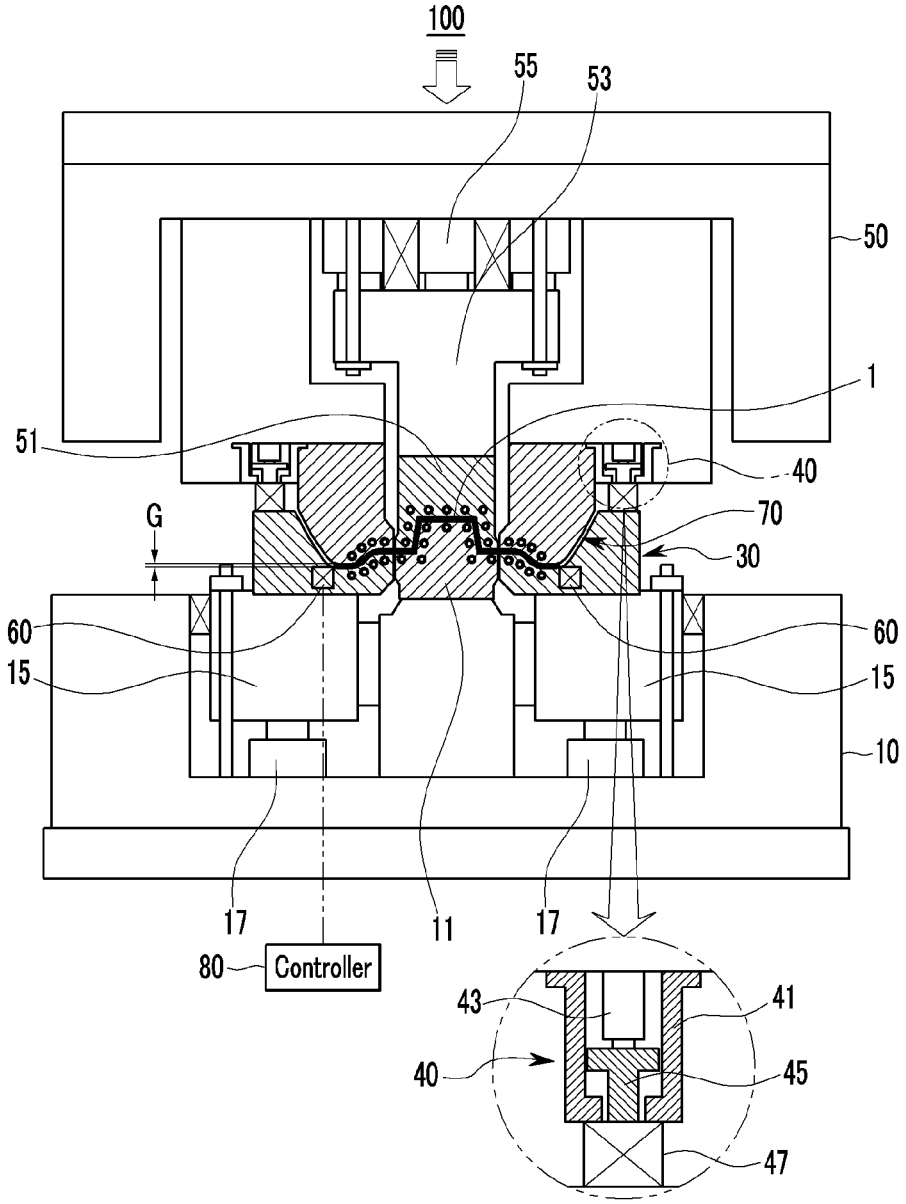

As shown in FIG. 6 and FIG. 9, the upper stanchion 50 may be moved downwardly toward the lower stanchion 10. Furthermore, the stroke block 45 of the gap forming unit 40 may be protruded to an exterior of the housing 41 by the gas spring 43 (refer to FIG. 5).

Additionally, the upper mold steel 51 and the upper trimming steel 70 of the upper stanchion 50 may press the material 1 using the lower mold steel 11 and the lower trimming steel 30 of the lower stanchion 10 to form the material 1 when the upper stanchion 50 moves downwardly (S12). Further, the upper pad 53 may surpass a pressure of the upper gas spring 55 and supply a compression force to the lower mold steel 11 through the upper mold steel 51. Simultaneously, the material 1 may be cooled by the coolant circulated in the lower and upper mold steels 11, 51 and the lower and upper trimming steels 30, 70 (S12).

Furthermore, the gap G of about 3 mm may be formed by the gap forming unit 40 between the lower and upper trimming steels 30, 70 corresponding to the edges of the material 1.

The stroke block 45 of the upper stanchion 50 may contact the stopping block 47 of the lower stanchion 10 when the upper stanchion 50 moves downwardly toward the lower stanchion 10. Further, when the stroke block 45 protrudes to the exterior of the housing 41, the stroke block 45 may surpass a pressure of the gas spring 43 by a repulsive force of the blank holder 15 generated by the lower gas spring 17, and may be compressed into the housing 41 by a set stroke length (e.g., about 3 mm). Thus, the gap G of about 3 mm may be formed between the lower trimming steel 30 and the upper trimming steel 70 corresponding to the edges of the material 1 according to the housing 41 being stopped by the stopping block 47.

The expansion of the edges of the material 1 by a high temperature may be prevented when the gap G of about 3 mm formed by the gap forming unit 40 between the lower trimming steel 30 and the upper trimming steel 70 corresponds to the edges of the material 1.

While the above processes are performed, the temperature of the material 1 may be decreased by the coolant circulating in the lower and upper mold steels 11, 51 and the lower and upper trimming steels 30, 70, and the temperature sensor 60 may detect the temperature of the material 1 and output the detected signal to the controller 80 (S13).

Subsequently, the controller 80 may receive the detected signal from the temperature sensor 60 and determine whether the temperature of the material 1 is in a range of the predetermined first set temperature at a step S14. Furthermore, the first set temperature range may be an optimum temperature condition to trim the edges of the material 1 at a high temperature, and the first set temperature may be predetermined to be about 250° C. to 800° C. by various experiments.

At the step S14, when the temperature of the material 1 is within the first set temperature range, as shown in FIG. 7 and FIG. 9, the pressure of the upper gas spring 55 may be surpassed by the upper pad 53 and the upper stanchion 50 may move downwardly. In addition, the lower trimming steel 30 and the upper trimming steel 70 may surpass the pressure of the lower gas spring 17 and move downwardly with the blank holder 15 to trim the edges of the material 1 (S15).

In this instance, the edges of the material 1 may be cut by the trimming blade 71 disposed at the upper trimming steel 70 when the lower trimming steel 30 and the upper trimming steel 70 move downwardly. Further, the firming blade 73 disposed at an upper side of the trimming blade 71 may firm burrs on the trimmed portion of the material 1 (refer to FIG. 2). In the trimming process of the edges of the material 1, the trimming blade 71 and the firming blade 73 may be mounted on the upper trimming steel 70 with a clearance corresponding to about 10% of a vertical thickness of the material to compensate for thermal expansion of the upper trimming steel 70 by the high temperature trimming (refer to FIG. 2).

The material 1 may be continuously cooled by the coolant circulating in the lower and upper mold steels 11, 51 and the lower and upper trimming steels 30, 70 during the above-mentioned process, and the controller 80 may receive the detected signal from the temperature sensor 60 and determine whether the temperature of the material 1 is within a range of the predetermined second set temperature that is lower than the first set temperature range (S16). Furthermore, the second set temperature range may be predetermined by a temperature condition when a phase of the material 1 is transformed to martensite according to the material 1 being cooled by the coolant, and the second set temperature range being about 200° C. to 250° C.

At the step S16, when the temperature of the material 1 is within the second set temperature range, as shown in FIG. 8 and FIG. 9, the upper stanchion 50 may move upwardly at a step S17.

In addition, the stroke block 45 of the gap forming unit 40 may be returned to the original position by the gas spring 43. Similarly, the upper pad 53 and the blank holder 15 may be returned to the original position when the upper stanchion 50 moves upwardly at the step S17. In this process, the firming blade 73 of the upper trimming steel 70 may inversely firm burrs on the trimmed portion of the material when the lower trimming steel 30 and the upper trimming steel 70 move upwardly together, and the trimming of the material 1 may be completed at the step S17 (refer to FIG. 2).

Finally, the hot stamping forming of the material 1 may be completed when the trimming completed material 1 being extracted by adsorbing of a vacuum adsorber (not shown), and a scrap generated by the trimming is extracted by a magnetic material at a step S18.

As described thus far, the device 100 and the method for hot stamping according to an exemplary embodiment of the present invention facilitate the heated material 1 to be formed and simultaneously cooled in only one mold, and is trimmed at a high temperature.

Advantageously, the high temperature trimming of the material may be performed simultaneously with forming and cooling the material. Additionally, only one mold may be necessary in the hot forming processor. Furthermore, ultra-high strength steel may be mass produced according to the present invention due a decrease in manufacturing costs. Moreover, size and assembly precision of the vehicle components may be improved by the present invention due to the removal of burrs on the trimmed portion of the material.

While this invention has been described in connection with what is presently considered to be exemplary embodiments, it is to be understood that the invention is not limited to the disclosed embodiments, but, on the contrary, is intended to cover various modifications and equivalent arrangements included within the spirit and scope of the appended claims.

What is claimed is:

1. A hot stamping device for forming, cooling and trimming a material heated at a set temperature, the device comprising:

a lower stanchion having a lower mold steel formed to a shape corresponding to a bottom surface of the material and a blank holder vertically movable along an exterior of the lower mold steel;

a lower trimming steel mounted on the blank holder, wherein the lower trimming steel is configured to support the edges of the material;

an upper stanchion having a upper mold steel formed to a shape corresponding to an upper surface of the material, wherein the upper stanchion is configured to move the upper mold steel up and down;

an upper trimming steel disposed on an exterior, wherein the upper trimming steel is configured to move downwardly with the lower trimming steel to trim the edges of the material; and a cooling unit disposed on the lower and the upper mold steels and the lower and the upper trimming steels, wherein the cooling unit is configured to circulate a coolant.

2. The device of claim 1, further comprising a gap forming unit disposed near the upper trimming steel and the lower trimming steel to form a gap between the lower and upper trimming steels.

3. The device of claim 1, further comprising a temperature sensor disposed on the lower trimming steel to detect a temperature of the material and output the detected temperature to a controller.

4. The device of claim 3, wherein the lower and the upper trimming steels move downwardly to trim the edges of the material when the temperature of the material detected by the temperature sensor is within a predetermined range of about 250° C. to 800° C.

5. The device of claim 1, wherein the upper trimming steel includes a trimming blade for trimming the edges of the material and at least one firming blade for firming the trimmed portion.

6. The device of claim 5, further comprising a pair of firming blades vertically disposed apart from each other in an upper side of the trimming blade.

7. The device of claim 5, wherein the trimming blade includes a tungsten carbide surfacing-welded to the upper trimming steel.

8. The device of claim 5, wherein the trimming blade and the pair of firming blades are mounted on the upper trimming steel and are disposed at a distance corresponding to 10% of a vertical material thickness.

9. The device of claim 2, wherein the gap forming unit comprises:

a plurality of housings mounted near the upper trimming steel;

a gas spring mounted in each housing;

a stroke block supported at a spring rod of the gas spring in each housing and protruded out of each housing; and a stopping block mounted toward the stroke block on the lower trimming steel.

10. The device of claim 9, wherein a stroke length of the stroke block is about 3 mm.

11. The device of claim 1, wherein the cooling unit is inserted into the lower and the upper mold steels and the lower and the upper trimming steels, and comprises a bush member configured to circulate the coolant.

12. The device of claim 1, wherein the cooling unit comprises:

a tank portion formed in the lower and the upper mold steels and the lower and the upper trimming steels; and a plurality of baffle plates disposed at the tank portion and configured to circulate the coolant.

13. The device of claim 1, wherein the cooling unit is formed in the lower and the upper mold steels and the lower and the upper trimming steels, and comprises a cooling channel configured to circulate the coolant.

14. A method for hot stamping comprising:

circulating a coolant into a lower and an upper mold steel and a lower and an upper trimming steel of a lower and an upper stanchion;

loading the material at a set temperature to the lower mold steel and the lower trimming steel of the lower stanchions;

forming the material by the lower and the upper mold steels and the lower and the upper trimming steels in response to a downward movement of the upper stanchion;

cooling the material with the coolant;

detecting a temperature of the material by a temperature sensor;

outputting the detected sensor signal to a controller;

trimming the edges of the material in response to the downward movement of the upper stanchion, wherein the lower and the upper trimming steels move downwardly with a blank holder when determined, by the controller, that the temperature of the material is within a first set temperature range; and completing the trimming in response to an upward movement of the upper stanchion, wherein the lower and the upper trimming steels move upwardly with the blank holder when determined, by the controller, that the temperature of the material is within a second set temperature range that is lower than the first set temperature range.

15. The method of claim 14, wherein a set gap is formed between the lower and the upper trimming steels corresponding to the edges of the material.

16. The method of claim 15, wherein the set gap between the lower and upper trimming steels is maintained at about 3 mm.

17. The method of claim 14, wherein the first set temperature range is about 250° C. to 800° C.

18. The method of claim 14, wherein the second set temperature range is about 200° C. to 250° C.

19. The method of claim 14, further comprising:

trimming the edges of the material by a trimming blade disposed on the upper trimming steel; and firming the trimmed edges of the material by a firming blade disposed on the upper trimming steel when the lower and the upper trimming steels move downwardly.

20. The method of claim 19, wherein the trimmed edges of the material are firmed by the firming blade when the lower and the upper trimming steels move upwardly.

* * * * *